US008947314B2

(12) United States Patent
Wong et al.

(10) Patent No.: US 8,947,314 B2
(45) Date of Patent: Feb. 3, 2015

(54) MOBILE COMMUNICATION DEVICE AND BUILT-IN ANTENNA INTEGRATED WITH A GROUND PORTION THEREOF

(75) Inventors: Kin-Lu Wong, Tapei Hsien (TW); Fang-Hsien Chu, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 479 days.

(21) Appl. No.: 12/849,066

(22) Filed: Aug. 3, 2010

(65) Prior Publication Data

US 2011/0227806 A1 Sep. 22, 2011

(30) Foreign Application Priority Data

Mar. 22, 2010 (TW) ..... 99108373 A

(51) Int. Cl.
*H01Q 1/48* (2006.01)
*H01Q 5/00* (2006.01)
*H01Q 1/24* (2006.01)

(52) U.S. Cl.
CPC ..... *H01Q 5/0068* (2013.01); *H01Q 1/243* (2013.01); *H01Q 1/48* (2013.01)
USPC ..... 343/848; 343/700 MS; 343/906

(58) Field of Classification Search
USPC ..... 343/848, 700 MS, 906
IPC ..... H01Q 5/0068,1/243, 1/48
See application file for complete search history.

(56) References Cited

U.S. PATENT DOCUMENTS

| | | | | |
|---|---|---|---|---|
| 7,486,242 | B2 * | 2/2009 | Gala Gala et al. | 343/702 |
| 7,623,074 | B2 | 11/2009 | Chi et al. | |
| 2004/0246180 | A1 * | 12/2004 | Okado | 343/700 MS |
| 2010/0134382 | A1 * | 6/2010 | Liu et al. | 343/906 |

FOREIGN PATENT DOCUMENTS

| | | | |
|---|---|---|---|
| CN | 101577364 | A | 11/2009 |
| CN | 101582534 | A | 11/2009 |

* cited by examiner

*Primary Examiner* — Sue A Purvis
*Assistant Examiner* — Jae Kim
(74) *Attorney, Agent, or Firm* — Alan D. Kamrath; Kamrath IP Lawfirm, P.A.

(57) ABSTRACT

A mobile communication device includes an antenna structure having a dielectric substrate and an antenna. The dielectric substrate includes a ground portion, a first non-ground portion, and a second non-ground portion. The ground portion further includes a main ground and a protruded ground electrically connected to the main ground and extending between the first non-ground portion and the second non-ground portion. The first non-ground portion and the second non-ground portion are separated by the protruded ground. One edge of the protruded ground aligns with one edge of the dielectric substrate. The antenna includes a feeding portion located in the first non-ground portion and a radiating portion extending over the protruded ground and having a first end located in the first non-ground portion and electrically connected to the main ground and a second end of the radiating portion is located in the second non-ground portion and electrically connected to the main ground. There is a coupling gap between the radiating portion and the feeding portion in the first non-ground portion, and the radiating portion is excited by the capacitive coupling effect from the feeding portion.

14 Claims, 4 Drawing Sheets

MOBILE COMMUNICATION DEVICE AND BUILT-IN ANTENNA INTEGRATED WITH A GROUND PORTION THEREOF

BACKGROUND OF THE INVENTION

1. Field of the Invention

The present invention relates to a mobile communication device and an antenna structure, and more particularly, to a mobile communication device and an antenna structure which has a built-in antenna to be integrated with a ground portion for disposing a data transmission element.

2. Description of the Related Art

With the evolution of wireless communication technologies, the wireless communication industry is developing vigorously. Mobile communication devices are designed to be lighter, thinner, shorter, and smaller, and to integrate multi-band operations. In a mobile communication device, the prior art technique disposes the antenna radiating portion directly in the non-ground portion of the system circuit board of the mobile communication device to reduce the Q factor of the antenna and to provide enough operating bandwidth to cover the wideband operation of the wireless wide area network (WWAN) such that the antenna size is minimized and multi-band operation is achieved. However, such an antenna for WWAN is usually disposed in a single non-ground portion.

For example, in the prior art, U.S. Pat. No. 7,623,074 B2 entitled "Multi-band antenna" discloses a mobile communication device comprising an antenna disposed in a single non-ground portion to achieve wideband operation. However, the antenna configuration of the mobile communication device makes it difficult to integrate the antenna with a data transmission element, such as a universal serial bus (USB) terminal in the mobile communication device. As a result, the inner space of the communication device cannot be arranged in the most efficient manner.

Therefore, it is necessary to provide a mobile communication device to solve the problems presented in the prior art techniques.

SUMMARY OF THE INVENTION

It is an object of the present invention to provide a mobile communication device and an antenna structure which integrates a built-in antenna and a data transmission element to provide more design freedom in arranging the inner space of the mobile communication device.

In order to achieve the above object, the present invention discloses a mobile communication device including an antenna structure having a dielectric substrate and an antenna. The dielectric substrate includes a ground portion, a first non-ground portion, and a second non-ground portion. The ground portion further includes a main ground and a protruded ground. The protruded ground is electrically connected to the main ground and extends between the first non-ground portion and the second non-ground portion, such that the first non-ground portion and the second non-ground portion are separated by the protruded ground. One edge of the protruded ground aligns with one edge of the dielectric substrate. The antenna is a planar structure located on the dielectric substrate. The antenna includes a feeding portion and a radiating portion. The feeding portion is located in the first non-ground portion. The radiating portion extends over the protruded ground, and has a first end located in the first non-ground portion and electrically connected to the main ground, and a second end of the radiating portion is located in the second non-ground portion and is electrically connected to the main ground. There is a coupling gap between the radiating portion and the feeding portion in the first non-ground portion, and the radiating portion is excited by the capacitive coupling effect from the feeding portion.

DETAILED DESCRIPTION OF THE PREFERRED EMBODIMENTS

The advantages and innovative features of the invention will become more apparent from the following detailed description when taken in conjunction with the accompanying drawings.

Figure 1:
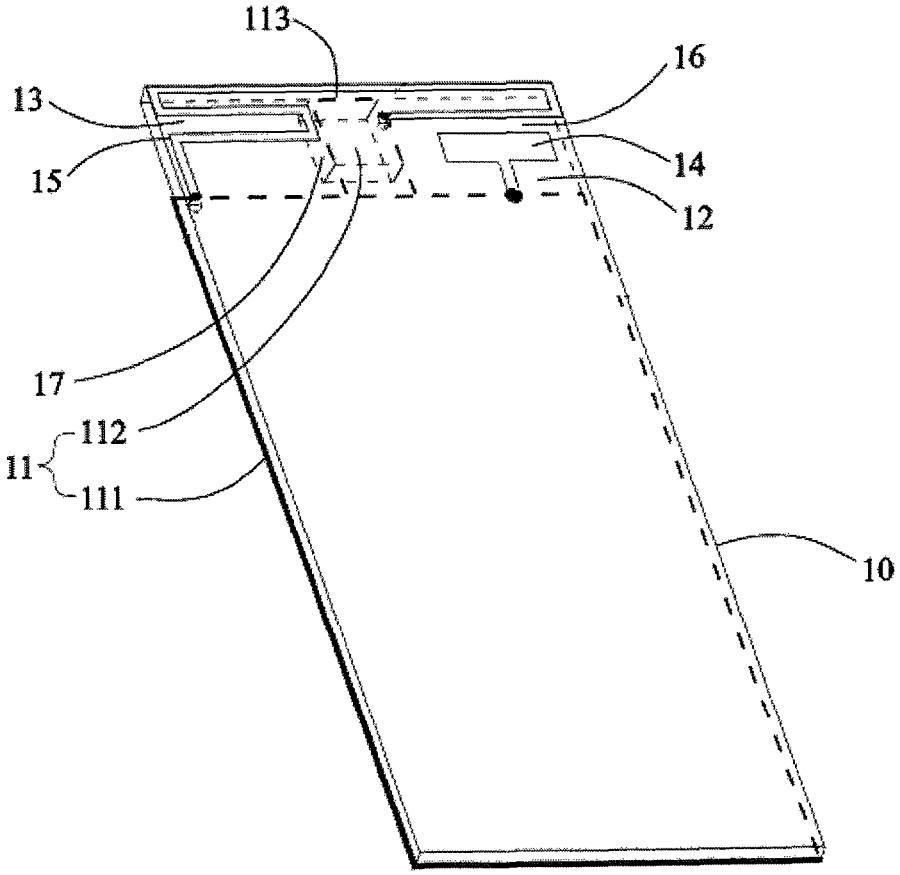
FIG. 1 illustrates a structural view of a first embodiment of a mobile communication device and an antenna structure of the present invention.

FIG. 1 illustrates a structural view of a first embodiment of a mobile communication device and an antenna structure of the present invention. A mobile communication device 1 includes an antenna structure having a dielectric substrate 10 and an antenna. The dielectric substrate 10 includes a ground plane or portion 11, a first non-ground region or portion 12, and a second non-ground region or portion 13. The ground portion 11 includes a main ground 111 and a protruded ground 112, with the protruded ground 112 electrically connected to main ground 111. The protruded ground 112 extends between the first non-ground portion 12 and the second non-ground portion 13, such that the first non-ground portion 12 and the second non-ground portion 13 are separated by the protruded ground 112. One edge of the protruded ground 112 aligns with one edge of the dielectric substrate 10. The antenna is a planar structure located on the dielectric substrate 10. The antenna includes a feeding strip or portion 14 and a radiating strip or portion 15. The feeding portion 14 is located in the first non-ground portion 12. The radiating portion 15 extends over the protruded ground 112. The radiating portion 15 has a first end located in the first non-ground portion 12 and electrically connected to the ground portion 11, and a second end of the radiating portion 15 is located in the second non-ground portion 13 and electrically connected to the ground portion 11. A coupling gap 16 is disposed between the radiating portion 15 and the feeding portion 14 in the first non-ground portion 12, and the radiating portion 15 is excited by the capacitive coupling effect from the feeding portion 14.

In this embodiment, the dielectric substrate 10 is a system circuit board of a mobile phone. The antenna has a first operating band covering at least the frequency band between 824 MHz and 960 MHz, and a second operating band covering at least the frequency band between 1710 MHz to 2170 MHz. The antenna can be printed or etched on the dielectric substrate 10. The radiating portion 15 includes a metal line of equal width and also includes seven bends. In this embodiment, the feeding portion 14 is formed in a T shape. The radiating portion 15 has one end electrically connected to the main ground 111 and another end electrically connected to the protruded ground 112.

In addition, the protruded ground 112 is provided for disposing a data transmission element 17 to provide a data transmission interface between the mobile communication device 1 and an external device (not shown).

Figure 2:
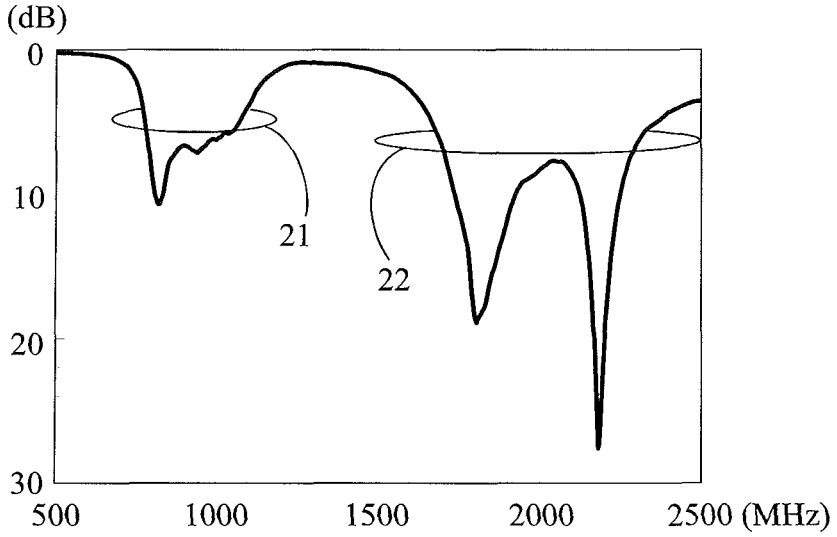
FIG. 2 illustrates a diagram of a measured return loss of the first embodiment of the mobile communication device of the present invention.

FIG. 2 illustrates a diagram of a measured return loss of the first embodiment of the mobile communication device of the present invention. In the first embodiment, the following specifications are selected for the experiment: the dielectric substrate 10 is approximately 115 mm long, 60 mm wide, and 0.8 mm thick; the main ground 111 is approximately 100 mm long and 60 mm wide; the protruded ground 112 is approximately 15 mm long and 10 mm wide; the first non-ground portion 12 is approximately 15 mm long and about 25 mm wide; and the second non-ground portion 13 is approximately 15 mm long and 25 mm wide.

From the experimental results, with the definition of 6 dB return loss (the design specification for mobile communication device), the bandwidth of the first operating band 21 can cover the two frequency bands of GSM850/900 operation; and the second operating band 22 can cover the three frequency bands of GSM1800/1900/UMTS operation. Therefore, the antenna can cover the five frequency bands of the WWAN operation. Furthermore, the size of the protruded ground 112 is sufficient for disposing a universal serial bus (USB) terminal to successfully integrate the antenna and the data transmission element 17.

Figure 3:
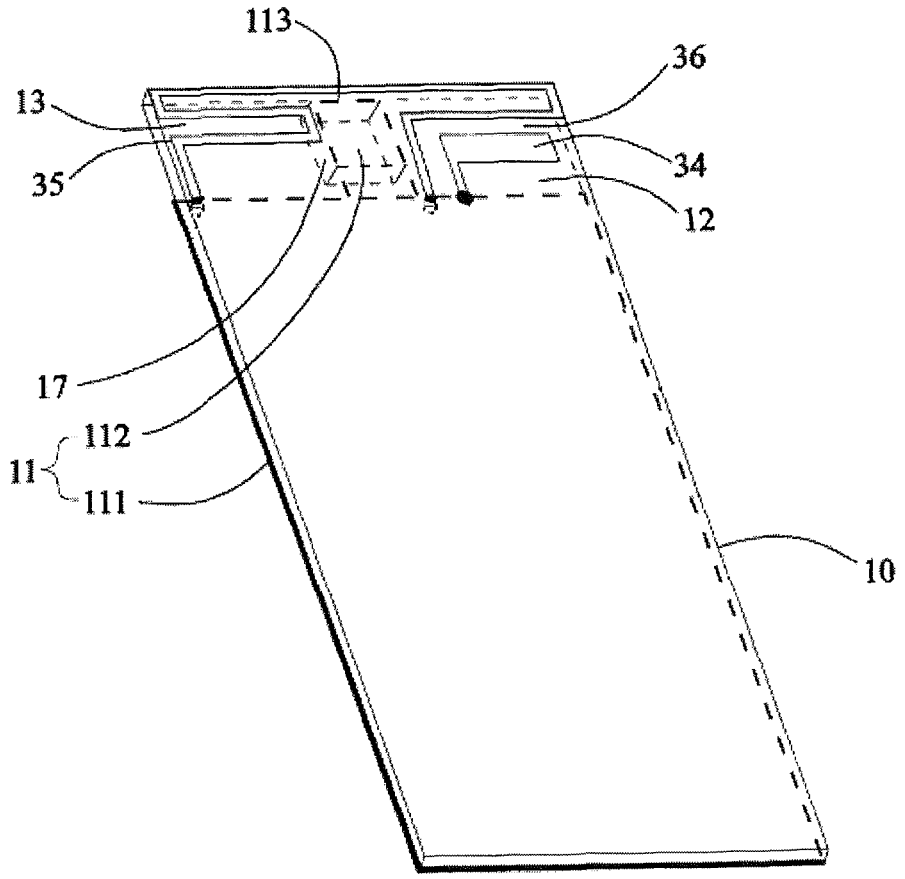
FIG. 3 illustrates a structural view of a second embodiment of the mobile communication device and an antenna structure of the present invention.

FIG. 3 illustrates a structural view of a second embodiment of the mobile communication device and an antenna structure of the present invention. A mobile communication device 3 includes an antenna structure having a dielectric substrate 10 and an antenna. The dielectric substrate 10 includes a ground plane or portion 11, a first non-ground region or portion 12, and a second non-ground region or portion 13. The ground portion 11 comprises a main ground 111 and a protruded ground 112. The antenna includes a feeding strip or portion 34 and a radiating strip or portion 35. The feeding portion 34 is located in the first non-ground portion 12. The radiating portion 35 extends over the protruded ground 112. The radiating portion 35 has a first end located in the first non-ground portion 12 and electrically connected to the ground portion 11, and a second end of the radiating portion 35 is located in the second non-ground portion 13 and electrically connected to the ground portion 11. A coupling gap 36 is disposed between the radiating portion 35 and the feeding portion 34 in the first non-ground portion 12.

The major difference between the second embodiment and the first embodiment is the feeding portion 34 is formed in an L shape, which is different from the shape of the feeding portion 14; and the radiating portion 35 has both ends electrically connected to the main ground 111, such that the radiating portion 15 has eight bends. Other structures in the second embodiment are similar to those disclosed in the first embodiment. Therefore, the second embodiment can provide effects similar to those described in the first embodiment.

Figure 4:
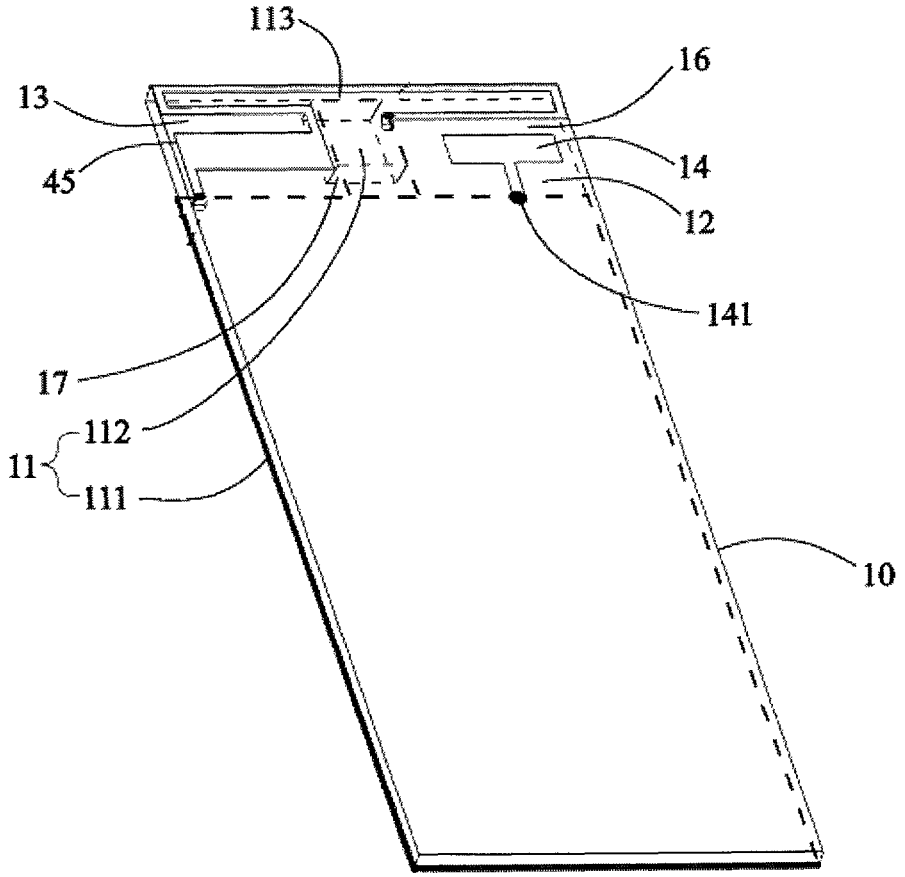
FIG. 4 illustrates a structural view of a third embodiment of the mobile communication device and an antenna structure of the present invention.

FIG. 4 illustrates a structural view of a third embodiment of the mobile communication device and an antenna structure of the present invention. A mobile communication device 4 includes an antenna structure having a dielectric substrate 10 and an antenna. The dielectric substrate 10 includes a ground plane or portion 11, a first non-ground region or portion 12, and a second non-ground region or portion 13. The ground portion 11 includes a main ground 111 and a protruded ground 112. The antenna includes a feeding strip or portion 14 and a radiating strip or portion 45. The feeding portion 14 is located in the first non-ground portion 12. The radiating portion 45 extends over the protruded ground 112. The radiating portion 45 has a first end located in the first non-ground portion 12 and electrically connected to the ground portion 11, and a second end of the radiating portion 45 is located in the second non-ground portion 13 and electrically connected to the ground portion 11. A coupling gap 16 is disposed between the radiating portion 45 and the feeding portion 14 in the first non-ground portion 12.

The major difference between the third embodiment and the first embodiment is the radiating portion 45 has a metal line of unequal width. In FIG. 4, the radiating portion 45 has one bend that is wider than the others for adjusting the impedance matching of the antenna. Other structures in the third embodiment are similar to those disclosed in the first embodiment. Therefore, the third embodiment can provide effects similar to those described in the first embodiment.

In summary, since one edge 113 of the protruded ground 112 aligns with one edge, a data transmission element 17 can be disposed on the protruded ground 112 to act as the data transmission interface between the mobile communication devices 1, 3 or 4 and an external device. The antenna further has a first operating band covering at least the frequency band between 824 MHz and 960 MHz (GSM850/900), and a second operating band at least covering the frequency band between 1710 MHz to 2170 MHz (GSM1800/1900/UMTS). Therefore, each of the antennas of the mobile communication devices 1, 3, 4 can cover the five frequency bands of the WWAN operation, such that the antenna and the data transmission element 17 can be integrated in order to provide more design freedom in arranging the inner space of the mobile communication device.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A mobile communication device comprising an antenna structure, with the antenna structure comprising:

a dielectric substrate having a planar surface, one edge, a ground plane, a first non-ground region, and a second non-ground region plane, wherein the ground plane comprises a main ground and a protruded ground, with the protruded ground electrically connected to the main ground and extending between the first non-ground region and the second non-ground region, wherein the first non-ground region and the second non-ground region are separated by the protruded ground; wherein the protruded ground has one edge at the one edge of the dielectric substrate;

wherein the protruded ground disposes a data transmission element directly to define a data transmission interface between the mobile communication device and an external device;

and an antenna being a planar structure and located on the planar surface of the dielectric substrate, with the antenna comprising a feeding strip and a radiating strip, wherein the feeding strip and the radiating strip are on a same plane as the, planar surface of the dielectric substrate, wherein the feeding strip is located inside the first non-ground region and does not overlap a part of the ground plane, wherein the feeding strip is not directly connected to the radiating strip, with the radiating strip extending over the protruded ground and having a first end located in the first non-ground region and directly connected to the main ground, with the radiating strip having a second end located in the second non-ground region and directly connected to the protruded ground, with a coupling gap disposed between the radiating strip and the feeding strip in the first non-ground region; wherein the radiating strip is excited by the capacitive coupling effect from the feeding strip via the coupling gap and the radiating strip does not overlap a part of the ground plane except over the protruded ground.

2. The mobile communication device as claimed in claim 1, wherein the dielectric substrate is a system circuit board of a mobile phone.

3. The mobile communication device as claimed in claim 1, wherein the antenna comprises a first operating band covering at least the frequency band between 824 MHz and 960 MHz, and a second operating band covering at least the frequency band between 1710 MHz to 2170 MHz.

4. The mobile communication device as claimed in claim 1, wherein the radiating strip comprises a metal line of fixed width or a metal line of non-uniform width.

5. The mobile communication device as claimed in claim 1, wherein the feeding strip is formed in a T shape or an L shape.

6. The mobile communication device as claimed in claim 1, wherein the radiating strip has one end electrically connected to the main ground and another end electrically connected to the protruded ground, respectively.

7. The mobile communication device as claimed in claim 1, wherein the radiating strip has two ends electrically connected to the main ground.

8. An antenna structure comprising: a dielectric substrate having a planar surface, a ground plane, a first non-ground region, and a second non-ground region, wherein the ground plane comprises a main ground and a protruded ground, with the protruded ground electrically connected to the main ground and extending between the first non-ground region and the second non-ground region, wherein the first non-ground region and the second non-ground region are separated by the protruded ground;

wherein the protruded ground disposes a data transmission element directly to define a data transmission interface between the mobile communication device and an external device;

and an antenna located on the planar surface of the dielectric substrate, with the antenna comprising a feeding strip and a radiating strip, wherein the feeding strip and the radiating strip are on a same plane as the planar surface of the dielectric substrate, wherein the feeding strip is located inside the first non-ground region and does not overlap a part of the ground plane, wherein the feeding strip is not directly connected to the radiating strip, with the radiating strip extending over the protruded ground and having a first end located in the first non-ground region and directly connected to the main ground, with the radiating strip having a second end located in the second non-ground region and directly connected to the protruded ground, with a coupling gap disposed between the radiating strip and the feeding strip in the first non-ground region; wherein the radiating strip is excited by the capacitive coupling effect from the feeding strip via the coupling gap and the radiating strip does not overlap a part of the ground plane except over the protruded ground.

9. The antenna structure as claimed in claim 8, wherein the protruded ground has one edge aligned with one edge of the dielectric substrate.

10. The antenna structure as claimed in claim 8, wherein the antenna comprises a first operating band covering at least the frequency band between 824 MHz and 960 MHz, and a second operating band covering at least the frequency band between 1710 MHz to 2170 MHz.

11. The antenna structure as claimed in claim 8, wherein the radiating strip comprises a metal line of fixed width or a metal line of non-uniform width.

12. The antenna structure as claimed in claim 8, wherein the feeding strip is formed in a T shape or an L shape.

13. The antenna structure as claimed in claim 8, wherein the radiating strip has one end electrically connected to the main ground and another end electrically connected to the protruded ground, respectively.

14. The antenna structure as claimed in claim 8, wherein the radiating strip has two ends electrically connected to the main ground.

* * * * *